US012157043B1

(12) United States Patent
Coruzzi

(10) Patent No.: US 12,157,043 B1
(45) Date of Patent: Dec. 3, 2024

(54) DIVOT REPAIR TOOL

(71) Applicant: Ronald A Coruzzi, Avondale, PA (US)

(72) Inventor: Ronald A Coruzzi, Avondale, PA (US)

(73) Assignee: DIVOT LLC, Wilmington, DE (US)

( * ) Notice: Subject to any disclaimer, the term of this patent is extended or adjusted under 35 U.S.C. 154(b) by 0 days.

(21) Appl. No.: 18/734,750

(22) Filed: Jun. 5, 2024

(51) Int. Cl.
*A63B 57/50* (2015.01)

(52) U.S. Cl.
CPC ..... *A63B 57/50* (2015.10)

(58) Field of Classification Search
CPC ..... A63B 57/0032; A63B 57/50
USPC ..... 473/286, 408
See application file for complete search history.

(56) References Cited

U.S. PATENT DOCUMENTS 3,763,515 A * 10/1973 Voss ..... A63B 57/50 15/236.08
4,984,790 A * 1/1991 Dowdy ..... A63B 57/50 473/408
5,085,431 A * 2/1992 McGuire ..... A63B 57/0037 473/386
5,121,519 A * 6/1992 Haugom ..... A63B 57/60 15/236.08
5,209,469 A * 5/1993 Laskowitz ..... A63B 57/50 172/378
5,441,118 A * 8/1995 Cruz, Jr. ..... A01B 1/16 172/381
5,529,299 A * 6/1996 Bellagamba ..... A63B 57/20 473/285
D436,152 S * 1/2001 Sanford, III ..... D21/793
6,224,502 B1 * 5/2001 Warfield ..... A63B 57/50 473/408
6,565,458 B1 * 5/2003 Cameron ..... A63B 57/50 473/408
6,893,357 B1 * 5/2005 Bennett ..... A63B 57/207 473/285
D508,104 S * 8/2005 Haug ..... D21/793
7,140,983 B2 * 11/2006 Pietsch ..... A63B 57/50 473/408
7,238,126 B1 * 7/2007 Wiens ..... A63B 57/50 473/408
7,604,554 B2 * 10/2009 Otsubo ..... A63B 57/10 473/401
7,731,609 B2 * 6/2010 Wiens ..... A63B 57/50 473/408
7,766,769 B2 * 8/2010 Lueders ..... A63B 57/50 224/666

(Continued)

*Primary Examiner* — Joseph B Baldori
(74) *Attorney, Agent, or Firm* — Invention To Patent Services; Alex Hobson

(57) ABSTRACT

A divot repair tool has a handle that extends along a plane and a prong portion having a first prong and second prong configured along a prong axis that is substantially orthogonal to the handle, or plane of the handle. This configuration enables easier manipulation of the divot repair tool to twist the ground around the divot inwards into the divot to better repair of the divot. A divot repair tool may be a monolithic part, such as a molded material or sheet of planar material that is cut and further manipulated to create the divot repair. A piece of metal may be stamped to form the general planar shape of the divot repair tool and then this stamped piece may be twisted to configure the prong axis substantially orthogonal from the handle plane and thereby form the twisted portion between the prong portion and handle.

20 Claims, 3 Drawing Sheets

(56) References Cited

U.S. PATENT DOCUMENTS

| | | | | |
|---|---|---|---|---|
| 8,162,778 | B1 * | 4/2012 | Rollinson | A63B 57/50 473/408 |
| 8,231,483 | B2 * | 7/2012 | Gill | A63B 57/353 473/408 |
| 8,439,768 | B1 * | 5/2013 | Shah | A63B 57/50 473/282 |
| 8,512,169 | B2 * | 8/2013 | Bohannon | A63B 57/50 473/406 |
| D698,884 | S * | 2/2014 | Otsubo | D21/793 |
| 8,882,611 | B2 * | 11/2014 | Schaaf | A63B 57/50 473/408 |
| D790,020 | S * | 6/2017 | Hubbard | D21/793 |
| 2002/0115507 | A1 * | 8/2002 | Gribovsky | A63B 57/50 473/406 |
| 2004/0038755 | A1 * | 2/2004 | Laux | A63B 57/50 473/408 |
| 2007/0111826 | A1 * | 5/2007 | Blanks | A63B 57/50 473/408 |
| 2007/0117657 | A1 * | 5/2007 | Prickett | B67B 7/403 473/387 |
| 2008/0051227 | A1 * | 2/2008 | Otsubo | A63B 57/50 473/408 |
| 2008/0153631 | A1 * | 6/2008 | Mazetta | A63B 57/50 473/408 |
| 2008/0220908 | A1 * | 9/2008 | Jaffe | A63B 57/207 473/406 |
| 2010/0248865 | A1 * | 9/2010 | Otsubo | A63B 57/50 473/408 |
| 2015/0202507 | A1 * | 7/2015 | Timberman | A63B 57/50 473/408 |

* cited by examiner

DIVOT REPAIR TOOL

BACKGROUND OF THE INVENTION

Field of the Invention

The invention relates a divot repair tool that provides improved manipulation to twist the ground around a divot mark to close the hole inward toward the center of the divot and includes a prong portion with prongs configured vertically along a prong axis that is substantially orthogonal to the plane of the handle with the top prong longer which allows for an economically easier angle to promote the repair of bail marks that improves the playing conditions of the green.

Background

Divot repair tools are used to repair divot marks on a golf green and usually include two prongs that extend from a handle. The prongs typically extend horizontally out from the handle wherein an axis between the prongs is parallel with or even in alignment with the plane of the handle. The prongs are inserted into the ground around a divot and then the handle is pressed downward toward the ground to lift the ground to lift the divot. This does not cover the divot with fresh grass but rather just lifts the divot and leaves a dirt spot on the green. Some people will resort to flipping existing tools to insert the prongs vertically and then move the entire divot tool inward toward the center of the divot in an attempt to push fresh ground and grass into the divot area. This is not ergonomic and difficult to close up the mark requiring increased hand pressure especially for some with arthritic hands.

SUMMARY OF THE INVENTION

An exemplary divot repair tool has a handle that extends along a plane and a prong portion having a first prong and second prong configured along a prong axis that is substantially orthogonal to the handle, or plane of the handle. This configuration enables easier manipulation of the divot repair tool to twist the ground around the divot inwards to close the divot hole with the thumb comfortably sitting at the twist point of the tool requiring less wrist and arm motions. The vertical prongs enable better repair of the divot. An exemplary divot repair tool is made of a monolith, made from a single piece of material, such as a molded material or sheet of planar material that is cut and further manipulated to create the divot repair tool as described herein. A piece of metal may be stamped to form the general planar shape of the divot repair tool and then this stamped piece may be twisted to configure the prong axis substantially orthogonal from the handle plane and thereby form the twisted portion between the prong portion and handle.

An exemplary divot repair tool has a handle and a prong portion including a pair of prongs with a twisted portion therebetween. The twisted portion is a twisted extension of the handle.

The length of the divot repair tool along the length axis from the handle end to the end of the tool may be about 50 mm or more, about 65 mm or more, about 75 mm or more, about 100 mm or less and any range between and including the length values provided. The overall length of the divot repair tool along the length axis may be 3.7 inches or about 94 mm. The handle has a length from the handle end to the tool end of the handle as measured along the length axis of the handle. This length may be about 40 mm or more, about 50 mm or more, about 65 mm or more, about 75 mm or less and any range between and including the length values provided. The length of the handle along the length axis may be 2.2 inches or about 56 mm. The handle has a width that extends from the first edge to the second edge along the width axis. The handle width may be about 10 mm or more, about 15 mm or more, about 20 mm or more, about 25 mm or more and any range between and including the width values provided. The length of the handle may be twice the width, or three times the width or even about four times the width of the handle and any range between and including the ratios provided. These ratios of length to width may be important for hand manipulation of the divot repair tool. The handle has a rounded handle end for comfort in the hand when using the divot repair tool. The handle has a thickness from a first surface to a second surface and this thickness may be uniform across the handle. The thickness may be about 1 mm or more, about 2 mm or more, about 2.5 mm or more, about 3 mm or more and any range between and including the thickness values provided. Again, the divot repair tool may be made out of a single piece or planar material that is stamped or otherwise cut and then twisted to form the divot repair tool.

The twisted portion is an extension from the handle that is twisted, wherein the first edge changes in orientation from the handle to the outer edge of the second prong and the second edge changes in orientation from the handle to the outer edge of the first prong. The first prong and second prong extend along a prong plane that is substantially orthogonal to the handle plane.

The first prong is longer than the second prong to reduce the force required for insertion into a ground surface. The length of the prongs is from the connected end, or most distal edge of the prong connector, to the extended end, and may be about 15 mm or more, about 20 mm or more, about 25 mm or more, about 30 mm or more, about 40 mm or more and any range between and including the length values provided. Also, the extended ends of the first prong and second prong have a prong axis that extends therethrough that is substantially orthogonal to the plane of the handle or width axis of the handle. The handle plane is defined by the planar surface of the first surface and second opposing surface that extend parallel wherein the handle is planar having a thickness from the first surface to the second surface. The divot repair tool has a twisted portion that couples the prong portion to the handle.

The prongs are also planar, each having a first surface and second surface that are parallel. The plane of the first prong and second prong are substantially orthogonal to the plane of the handle. The first prong has a length that is greater than the length of the second prong. There is a prong offset distance between the first prong extended end and the second prong extended end. This enables easier insertion into a ground surface as described herein. The extended ends of the prongs extend at an end-angle to aid in the insertion of the prong into the ground.

The first prong has a first edge along the outer portion of the prong and a second edge proximal to the second prong or along an inner edge of the first prong. The first prong has a thickness from a first surface to a second surface. The first prong has a length from a connected end to the extended end. The extended ends of the first and second prongs extend at an end-angle to produce a pointed surface or edge at the extended end for facilitating ground insertion. As described herein, the end-angle is an angle from orthogonal to the length axis or width axis of the handle. Note that the extended end-angles extend inward toward the handle and towards the opposing prong, wherein the extended end-angle of the first prong extends from the first edge back toward the handle end, and wherein the extended end-angle of the second prong extends from the first edge back toward the handle end.

The second prong has a first edge along the outer portion of the prong and a second edge proximal to the first prong or along an inner edge of the first prong. The second prong has a thickness from a first surface to a second surface. The second prong has a length from a connected end to the extended end. The extended end extends at an angle to produce a pointed surface at the extended end for facilitating ground insertion.

The first twisted portion extends from the handle to the first prong and the second twisted portion extends from the handle to the second prong. The two twisted portions twist from the width axis or the handle to the prong axis hat extends between the first prong and second prong. The prong axis may be substantially orthogonal to the width axis wherein the prong offset angle between the width axis of the handle and the prong axis along the first prong is between 75 degrees and 105 degrees The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
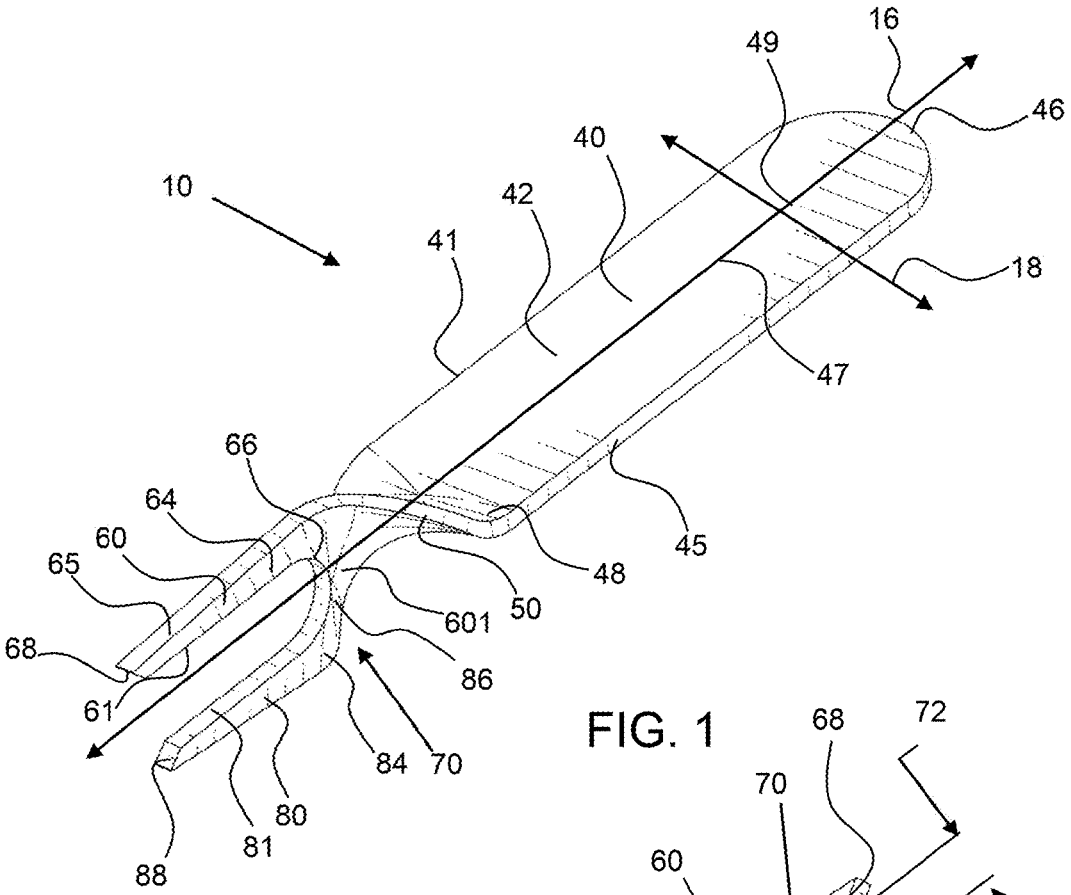
FIG. 1 shows a perspective view of the divot repair tool.

Corresponding reference characters indicate corresponding parts throughout the several views of the figures. The figures represent an illustration of some of the embodiments of the present invention and are not to be construed as limiting the scope of the invention in any manner. Some of the figures may not show all of the features and components of the invention for ease of illustration, but it is to be understood that where possible, features and components from one figure may be an included in the other figures. Further, the figures are not necessarily to scale, some features may be exaggerated to show details of particular components.

Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

Figure 2:
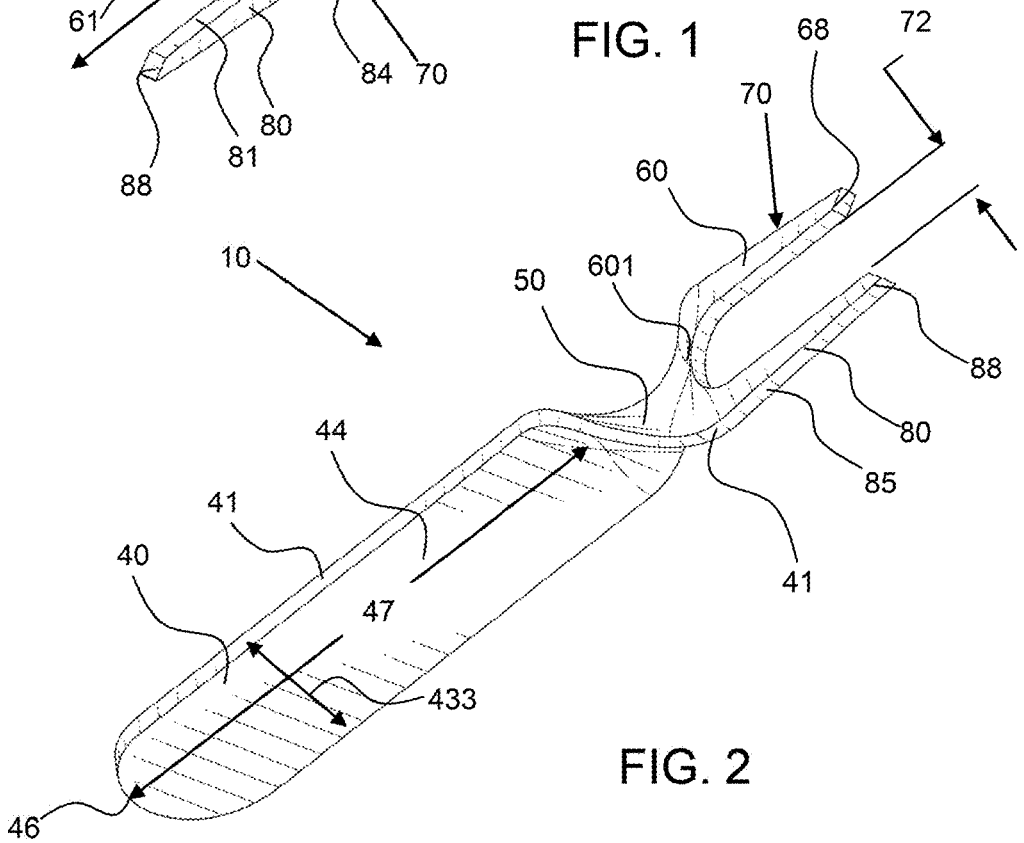
FIG. 2 shows a perspective view of the divot repair tool.
Figure 4:
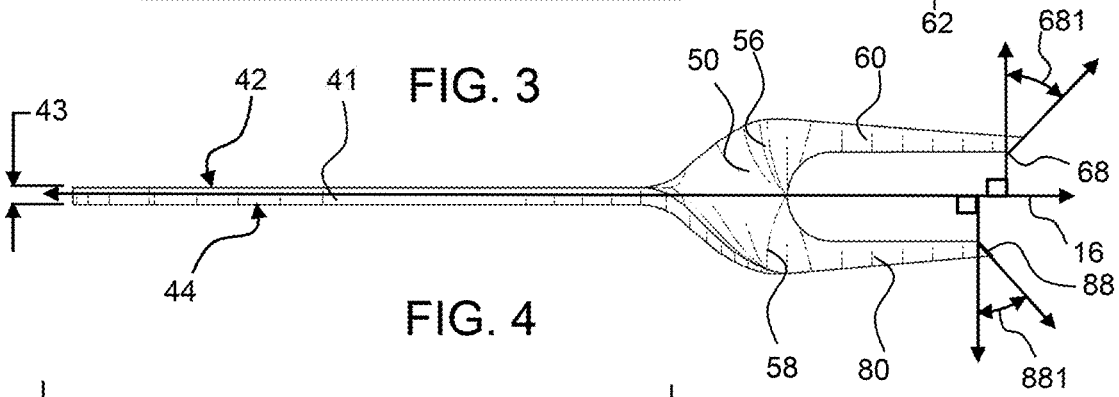
FIG. 4 shows a first edge side view of the divot repair tool.
Figure 8:
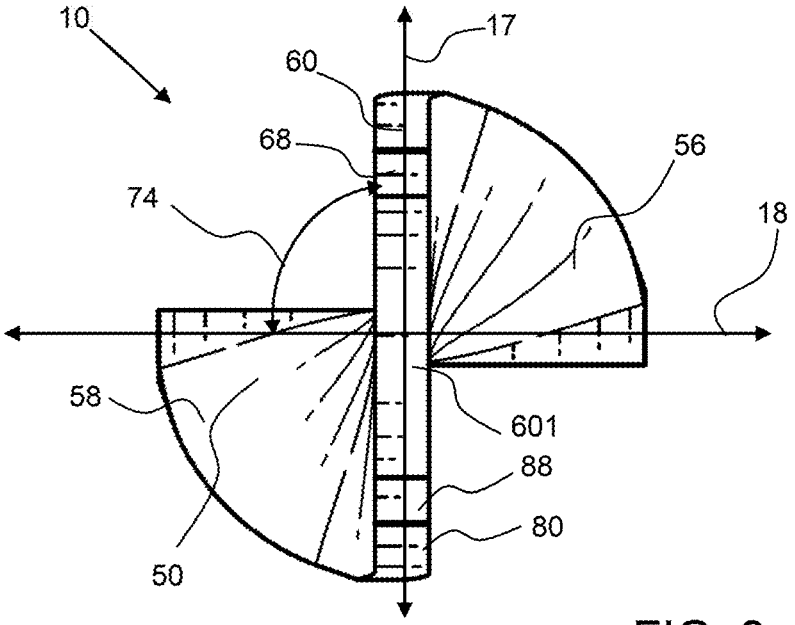
FIG. 8 shows a prong end view of the divot repair tool.

Referring now to FIGS. 1 and 8, the divot repair tool has a handle 40 and a prong portion 70 including a pair of prongs extending from a twisted portion 50 between the handle and the prongs. The twisted portion 50 is a twisted extension of the handle 40. The first prong 60 is longer than the second prong 80 and both extend along a prong axis 17 that is substantially orthogonal to the plane 49 of the handle or width axis 18 of the handle 40. A prong gap distance 72 between the first prong 60 and second prong 80 is shown in FIG. 2 and is the distance between the most proximal edges of the prongs. The handle plane 49 is defined by the planar surface of the first surface 42 and second opposing surface 44 that extend parallel wherein the handle is planar having a thickness 43 (shown in FIG. 4) from the first surface 42 to the second surface 44. The divot repair tool has a twisted portion 50 that couples the prong portion 70 to the handle 40.

The prongs are also planar, each having a first surface and second surface that are parallel. The plane of the first prong 60 and second prong 80 are substantially orthogonal to the plane of the handle 40. The first prong 60 has a length 76 that is greater than the length 78 of the second prong 80. There is a prong offset distance 75 between the first prong extended end 68 and the second prong extended end 88. This enables easier insertion into a ground surface as described herein. The extended ends of the prongs extend at an end-angle to aid in the insertion of the prong into the ground.

The handle has a length 47 from the handle end 46 to the tool end 48 as measured along the length axis 16 of the handle. The tool end is the end of the plane of the planar handle and the beginning of the twisted portion 50. The handle has a width 433 that extends from the first edge 41 to the second edge 45 along the width axis 18. The handle has a rounded handle end 46 for comfort in the hand when using the divot repair tool 10. The handle has a thickness 43 from a first surface 42 to a second surface 44 and this thickness may be uniform across the handle.

Figure 3:
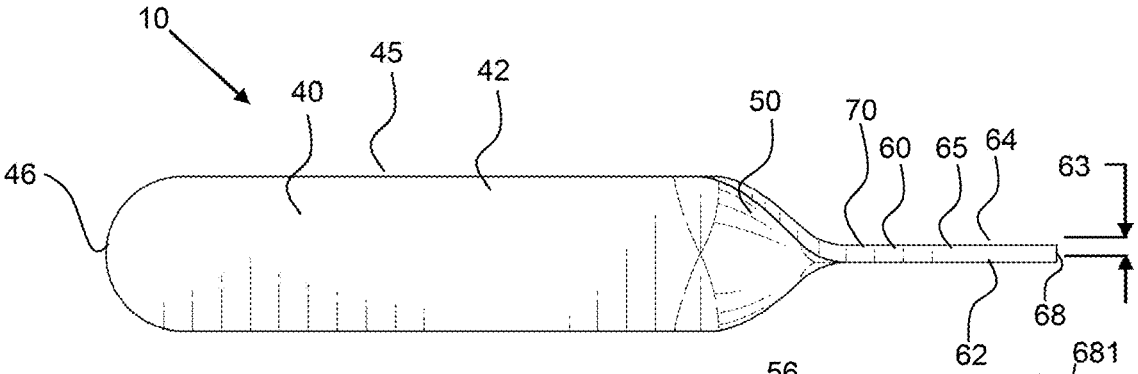
FIG. 3 shows a first surface side view of the divot repair tool.
Figure 5:
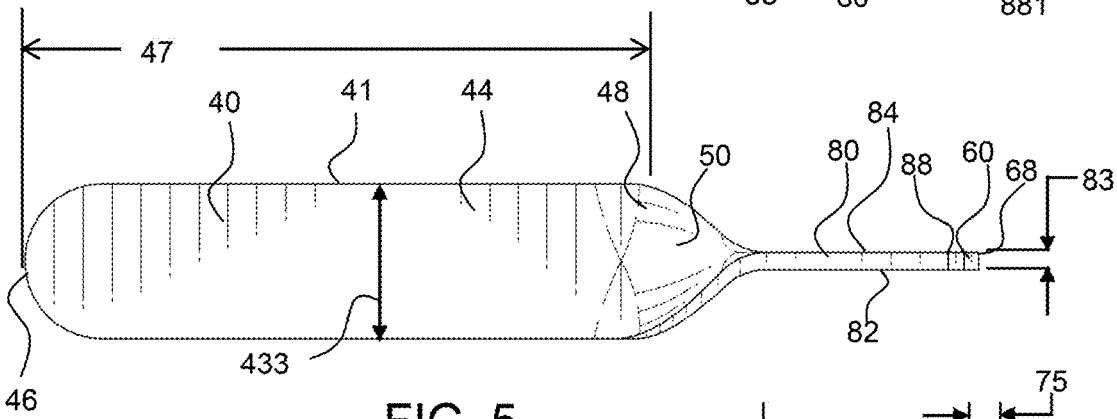
FIG. 5 shows a second surface side view of the divot repair tool.
Figure 6:
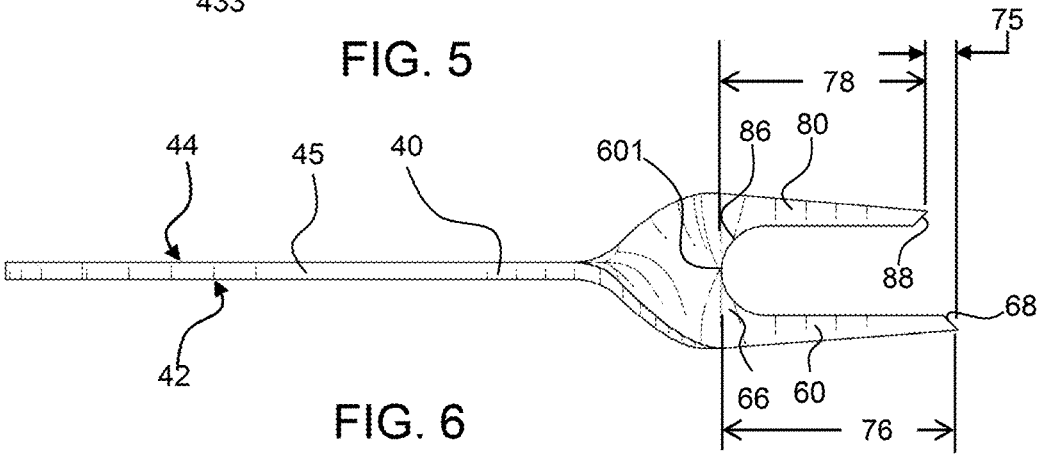
FIG. 6 shows a second edge view of the divot repair tool.

The twisted portion 50 is a planar extension from the handle that is twisted, wherein the first edge 41 changes in orientation from the handle to the outer edge of the second prong and the second edge 45 changes in orientation from the handle to the outer edge of the first prong 60. The first prong 60 and second prong 80 extend along a prong plane that is substantially orthogonal to the handle plane 49, as best shown in FIGS. 3 and 5. The twisted portion includes the prong connector 601, the portion of the divot repair tool 10 between the prongs and the planar handle, which includes a curved edge between the two prongs. The length of a prong is measured from this curved edge of the prong connector to the extended end of the respective prong.

The first prong has a first edge 65 along the outer portion of the prong and a second edge 61 proximal to the second prong 80 or along an inner edge of the first prong. The first prong has a thickness 63 from a first surface 62 to a second surface 64. The first prong 60 has a length 76 from a connected end 66 to the extended end 68. A width of the first prong may about the same as the thickness of the prong. The extended ends of the first and second prongs extend at an end-angle 681, 881 respectively, to produce a pointed surface or edge at the extended end for facilitating ground insertion. As described herein, the end-angle is an angle from orthogonal to the length axis 16 or width axis 18 of the handle, as shown in FIG. 1. Note that the extended end-angles extend inward toward the handle and towards the opposing prong, wherein the extended end-angle 681 of the first prong 60 extends from the first edge 65 back toward the handle end, and wherein the extended end-angle 881 of the second prong 80 extends from the first edge 85 back toward the handle end 46.

The second prong has a first edge 85 along the outer portion of the prong and a second edge 81 proximal to the first prong 60 or along an inner edge of the first prong. The second prong has a thickness 83 from a first surface 82 to a second surface 84. The second prong 80 has a length 88 from a connected end 86 to the extended end 88. A width of the second prong may about the same as the thickness of the prong. The extended end extends at an angle to produce a pointed surface at the extended end for facilitating ground insertion.

Figure 7:
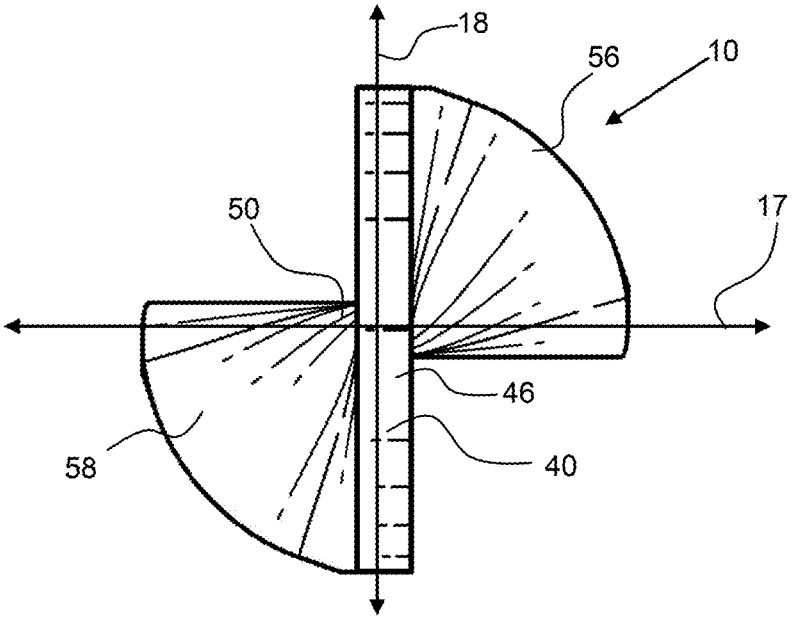
FIG. 7 shows a handle end view of the divot repair tool.

Referring now to FIGS. 7 and 8, the first twisted portion 56 extends from the handle 40 to the first prong 60 and the second twisted portion 58 extends from the handle to the second prong 80. The two twisted portions twist from the width axis or the handle 18 to the prong axis 17 that extends between the first prong 60 and second prong 80. The prong axis 17 may be substantially orthogonal to the width axis 18 of the handle, wherein the prong offset angle 74 between the width axis 18 of the handle and the prong axis along the first prong 60 is between 75 degrees and 105 degrees.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A divot repair tool comprising:

a) a handle extending along a length axis and having a width extending along a width axis; said handle comprising:
   i) a first edge; and
   ii) a second edge;

b) a prong portion comprising:
   i) a first prong;
   ii) a second prong; and c) a twisted portion between the handle and the prong portion; wherein along the twisted portion the first edge changes in orientation from the handle to the outer edge of the second prong and the second edge changes in orientation from the handle to the outer edge of the first prong;

and wherein a prong axis extends between the first prong and second prong at a prong offset angle from said width axis of the handle that is between 75 degrees and 105 degrees from said width axis of the handle.

2. The divot repair tool of claim 1, wherein the prong portion consists of two prongs, said first prong and said second prong.

3. The divot repair tool of claim 1, wherein the prong offset angle is between 80 degrees and 100 degrees.

4. The divot repair tool of claim 1, wherein the prong offset angle is between 85 degrees and 95 degrees.

5. The divot repair tool of claim 1, wherein the first prong is longer than the second prong by a prong length offset of at least 5 mm.

6. The divot repair tool of claim 1, wherein the first prong extends from a connected end, connected to a prong connector, to an extended end.

7. The divot repair tool of claim 6, wherein the extended end of the first prong extends at an end-angle of at least 30 degrees from the prong axis, wherein the extended end of the first prong extends inward toward the handle and the second prong.

8. The divot repair tool of claim 7, wherein the second prong extends from a connected end, connected to said prong connector, to an extended end.

9. The divot repair tool of claim 8, wherein the extended end of the second prong extends at an end-angle of at least 30 degrees from the prong axis, wherein the extended end of the second prong extends inward toward the handle and the first prong.

10. The divot repair tool of claim 9, wherein the prong offset angle is between 80 degrees and 100 degrees.

11. The divot repair tool of claim 9, wherein the prong offset angle is between 85 degrees and 95 degrees.

12. The divot repair tool of claim 9, wherein the first prong is longer than the second prong by a prong length offset of at least 5 mm.

13. The divot repair tool of claim 9, wherein the handle has a length of at least 35 mm.

14. The divot repair tool of claim 9, wherein the handle has a length of at least 50 mm.

15. The divot repair tool of claim 9, wherein the prong portion has a length that is no more than half the length of the handle.

16. The divot repair tool of claim 1, wherein the handle has a length of at least 35 mm.

17. The divot repair tool of claim 1, wherein the handle has a length of at least 50 mm.

18. The divot repair tool of claim 17, wherein the twisted portion has a length along the length axis of no more than 20 mm.

19. The divot repair tool of claim 18, wherein the prong portion has a length along the length axis of at least 20 mm.

20. The divot repair tool of claim 18, wherein the prong portion has a length that is no more than half the length of the handle.

* * * * *